US008298017B2

(12) United States Patent
Tanaka

(10) Patent No.: US 8,298,017 B2
(45) Date of Patent: Oct. 30, 2012

(54) CONNECTOR WITH A SURFACE HAVING POWER CONTACTS WITH A SAME POTENTIAL ARRANGED ADJACENTLY THEREON

(75) Inventor: Nobuyuki Tanaka, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/206,742

(22) Filed: Aug. 10, 2011

(65) Prior Publication Data

US 2011/0294357 A1 Dec. 1, 2011

Related U.S. Application Data

(63) Continuation-in-part of application No. PCT/JP2010/051829, filed on Feb. 8, 2010.

(30) Foreign Application Priority Data

Feb. 10, 2009 (JP) ..... 2009-028725

(51) Int. Cl.
*H01R 24/00* (2006.01)

(52) U.S. Cl. ..... 439/660

(58) Field of Classification Search ..... 439/660, 439/638, 607.06, 607.07, 607.35–607.4, 439/924.1, 941
See application file for complete search history.

(56) References Cited

U.S. PATENT DOCUMENTS

2001/0027041 A1 10/2001 Naito et al.
2002/0039857 A1 4/2002 Naito et al.
2009/0017693 A1* 1/2009 Nagata et al. ..... 439/660

FOREIGN PATENT DOCUMENTS

JP H09-163200 A 6/1997
JP 2001-345151 A 12/2001
JP 2003-255698 A 9/2003

OTHER PUBLICATIONS

Japan Patent Office, International Search Report for International Application No. PCT/JP2010/051829 (counterpart to above-captioned patent application), mailed Mar. 23, 2010.

* cited by examiner

*Primary Examiner* — R S Luebke
*Assistant Examiner* — Harshad Patel
(74) *Attorney, Agent, or Firm* — Baker Botts L.L.P.

(57) ABSTRACT

A connector including: a housing having an opening into which a plug is detachably inserted and an insertion member other than the plug can be inserted; and a plurality of contacts that includes a power contact and a ground contact and is configured to contact a plurality of contacts of the plug in the opening, wherein the power contact is arranged on a first surface and the ground contact is arranged on a second surface, a position of the first surface being different from a position of the second surface.

4 Claims, 7 Drawing Sheets

FIG. 9

15

| | |
|---|---|
| C1 | FIRST POWER CONTACT |
| C2 | FIRST POWER CONTACT |
| C3 | FIRST POWER CONTACT |
| C4 | FIRST POWER CONTACT |
| C5 | FIRST POWER CONTACT |
| C6 | DATA SIGNAL CONTACT |
| C7 | DATA SIGNAL CONTACT |
| C8 | SECOND POWER CONTACT |
| C9 | SECOND POWER CONTACT |
| C10 | SECOND POWER CONTACT |
| C11 | DATA SIGNAL CONTACT |
| C12 | DATA SIGNAL CONTACT |
| C13 | THIRD POWER CONTACT |
| C14 | THIRD POWER CONTACT |
| C15 | THIRD POWER CONTACT |

15

| | |
|---|---|
| C30 | GROUND CONTACT |
| C29 | GROUND CONTACT |
| C28 | CLOCK SIGNAL CONTACT |
| C27 | GROUND CONTACT |
| C26 | CLOCK SIGNAL CONTACT |
| C25 | GROUND CONTACT |
| C24 | GROUND CONTACT |
| C23 | GROUND CONTACT |
| C22 | GROUND CONTACT |
| C21 | GROUND CONTACT |
| C20 | CLOCK SIGNAL CONTACT |
| C19 | GROUND CONTACT |
| C18 | CLOCK SIGNAL CONTACT |
| C17 | GROUND CONTACT |
| C16 | GROUND CONTACT |

CONNECTOR WITH A SURFACE HAVING POWER CONTACTS WITH A SAME POTENTIAL ARRANGED ADJACENTLY THEREON

CROSS-REFERENCE TO RELATED APPLICATIONS

This application is a continuation-in-part of International Patent Application No. PCT/JP2010/051829, filed Feb. 8, 2010, which claims the benefit of Japanese Patent Application No. 2009-028725, filed Feb. 10, 2009, the disclosures of which are incorporated herein by reference in their entirety.

TECHNICAL FIELD

Aspects of the invention relate to a connector, and more particularly, to a connector that is used, for example, for interface connection in various small-sized electronic devices and into which a plug serving as a male connector is detachably inserted.

BACKGROUND

Generally, a connector that is used for interface connection in various small-sized electronic devices includes a housing having an opening, into which a plug serving as a male connector is detachably inserted, and a plurality of contacts that includes a power contact and a ground contact and is configured to contact a plurality of contacts of the plug in the opening.

Further, in a related-art connector apparatus, eight contacts are juxtaposed in a width direction to a second connector to which a first connector serving as a male connector is mounted and a ground contact and a power contact among the contacts are arranged on a same plane.

The second connector disclosed in related-art has a mount part to which the first connector is detachably mounted. The mount part has such a size that a memory card, which is an insertion member other than the first connector, can be inserted therein. In addition, the second connector has a plurality of contacts that is juxtaposed in the width direction. Usually, widths of each of the plurality of contacts are narrower than a contact width of the memory card. An exemplary connector has a contact width of 0.2 mm and an arrangement interval of 0.3 mm, while an exemplary memory card has a contact width of 1.0 mm and an arrangement interval of 0.2 mm. Here, the contact width is a width of a contact and the arrangement interval is an interval between adjacent contacts.

The arrangement interval 0.2 mm of the memory card is narrower than the arrangement interval 0.3 mm of the connector and each contact width 1.0 mm of the memory card is excessively wider than each contact width 0.2 mm of the connector. Accordingly, when the memory card is erroneously mounted to the mount part to which the first connector is configured to be mounted, due to a positional relationship between the contacts, the contacts adjacent to each other are shorted out. In addition, in a case where the ground contact and the power contact are arranged adjacent to each other, when the memory card is mounted to the mount part by mistake, the short may be caused, so that reliability is greatly lowered.

SUMMARY

According to an aspect of the invention, a connector, in which a power contact and a ground contact is not shorted even when an insertion member other than a plug, for example, a memory card, is erroneously mounted therein, is provided. The reliability of the connector is remarkably improved thereby.

According to an aspect of the invention, there is provided a connector including: a housing having an opening into which a plug is detachably inserted and an insertion member other than the plug can be inserted; and a plurality of contacts that includes a power contact and a ground contact and is configured to contact a plurality of contacts of the plug in the opening, wherein the power contact is arranged on a first surface and the ground contact is arranged on a second surface, a position of the first surface being different from a position of the second surface.

According to another aspect of the invention, there is provided a connector including: a housing; an opening that is provided to the housing and into which a plug is configured to be detachably inserted; and a plurality of contacts that includes a power contact and a ground contact and is configured to contact a plurality of contacts of the plug in the opening, wherein the power contact is arranged on a first surface and the ground contact is arranged on a second surface, a position of the first surface being different from a position of the second surface.

BRIEF DESCRIPTION OF DRAWINGS

FIG. 9 illustrates types of the respective contacts arranged in FIG. 8.

DETAILED DESCRIPTION

Hereinafter, illustrative embodiments of the invention will be described with reference to the drawings. The illustrative embodiments show a connector that is used, for example, for interface connection in various small-sized electronic devices.

A schematic configuration of a connector according to an illustrative embodiment is described with reference to FIGS. 1 to 5.

In the descriptions hereinafter, an opening side of the connector is a front side, an opposite side thereof is a backside, a leg part side, which is configured to be attached to a substrate, is a lower side and an opposite side thereof is an upper side.

Figure 1:
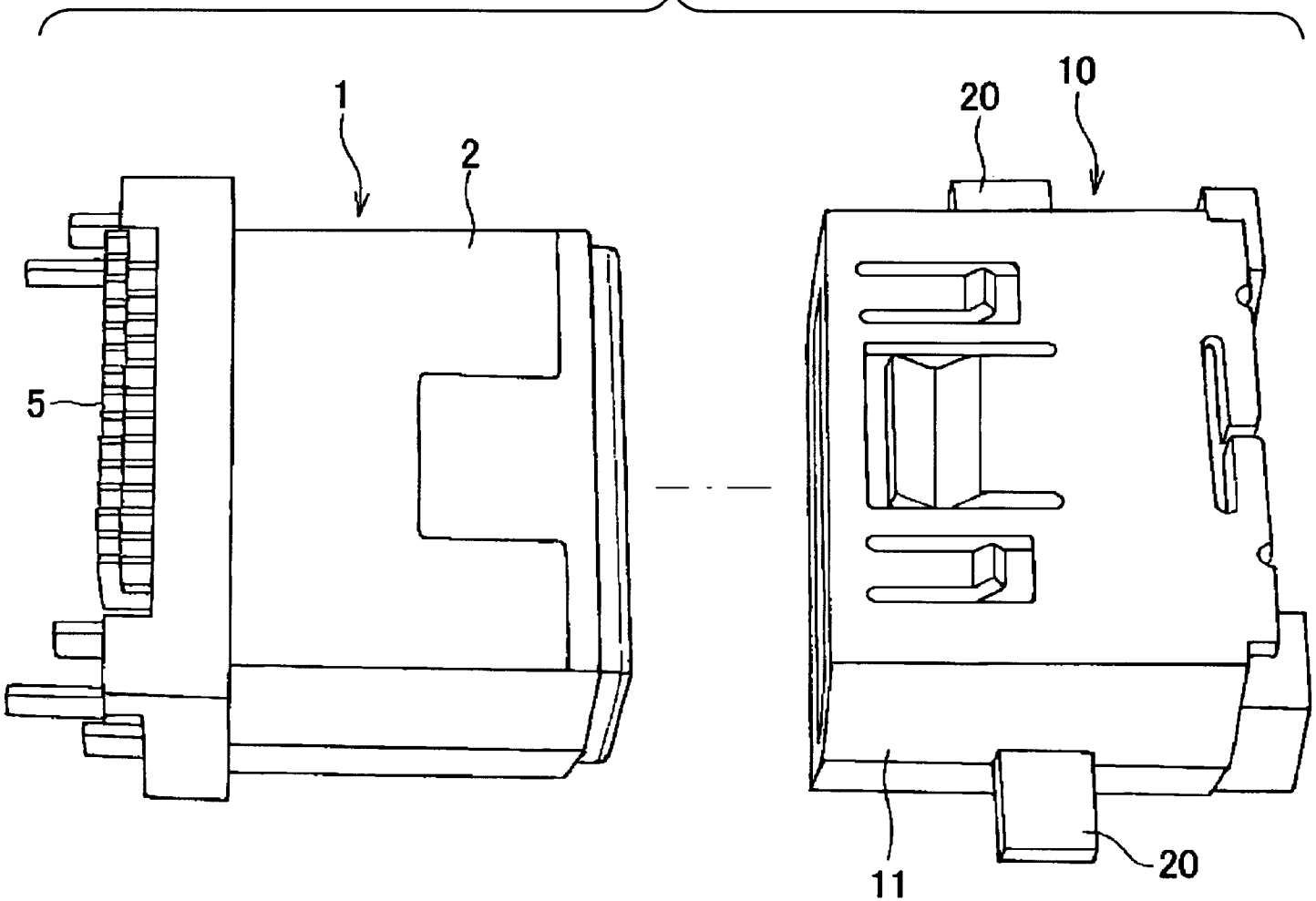
FIG. 1 is a perspective view showing a connector according to an illustrative embodiment of the invention and a plug.
Figure 2:
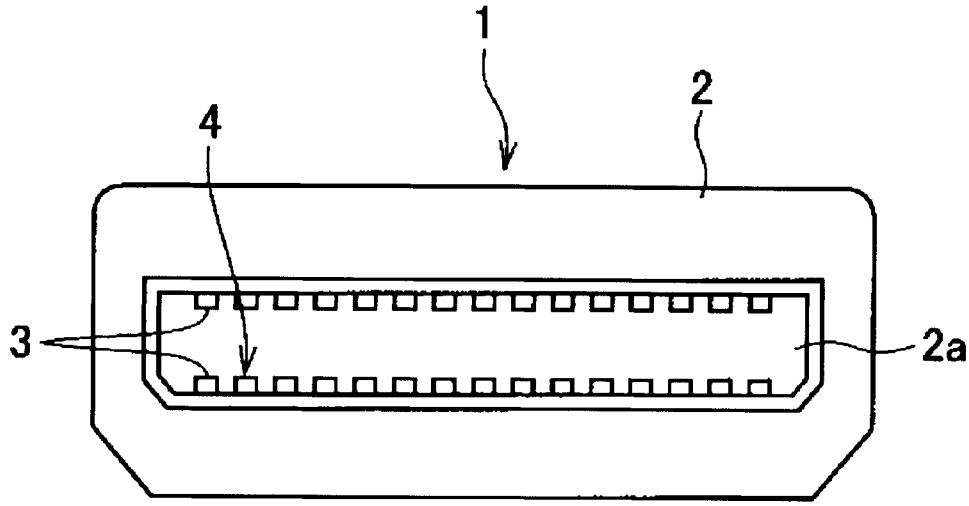
FIG. 2 is a front view of the plug shown in FIG. 1.
Figure 3:
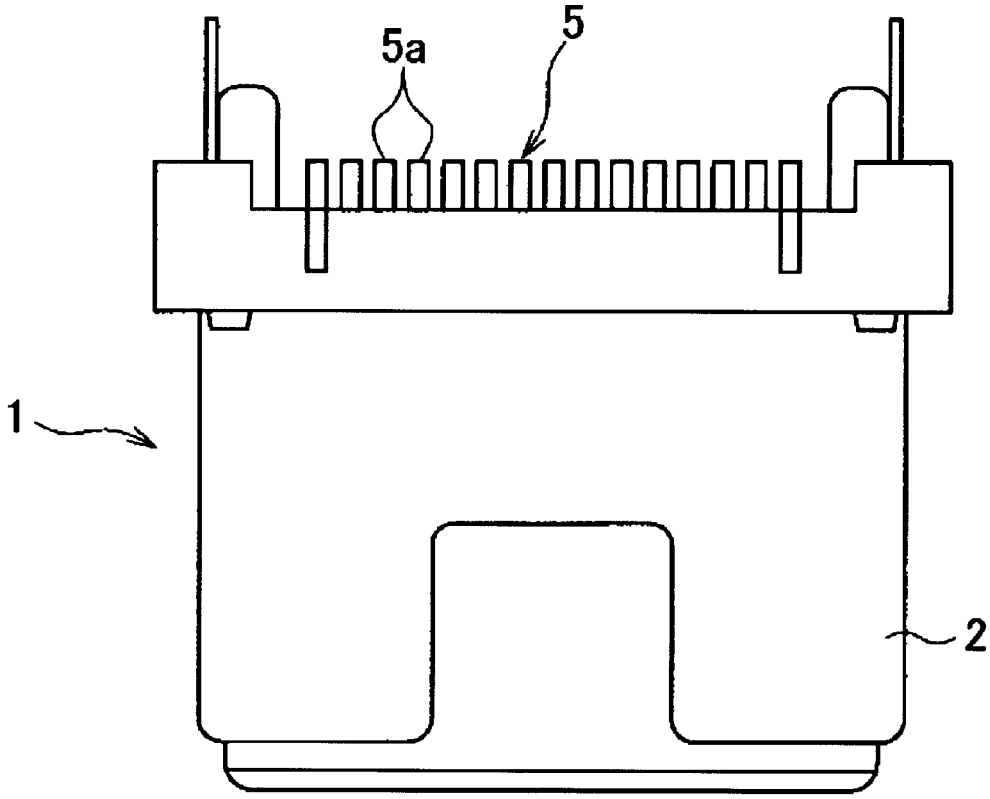
FIG. 3 is a plan view of FIG. 2.

As shown in FIGS. 1 to 3, a plug 1 serving as a male connector has an insertion part 2, a contact part 4 having a plurality of contacts 3, which are juxtaposed at upper and lower portions thereof, and a terminal part 5 for connection. The insertion part 2 has a front shape of a substantially inverted trapezoidal frame shape and has an opening 2*a* at an inside thereof. The contact part 4 having the plurality of contacts 3 such as signal contact, power contact, ground contact and the like, which are juxtaposed, is arranged on an upper surface and a lower surface of the opening 2*a*. The terminal part 5 for connection has a plurality of connection pins 5*a*, which are juxtaposed at upper and lower portions thereof and are electrically connected to predetermined portions of a substrate which is not shown.

Figure 4:
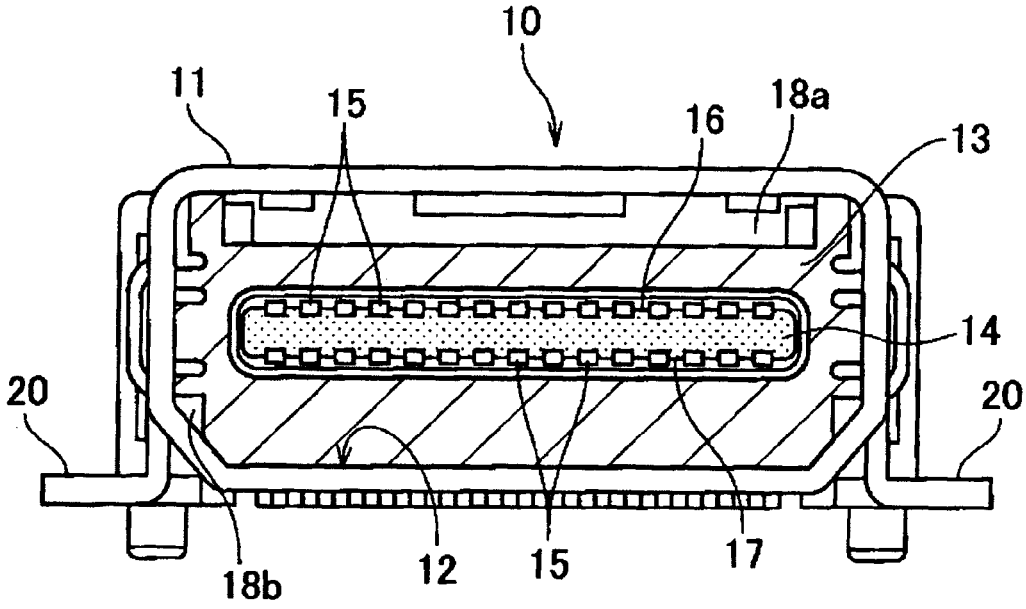
FIG. 4 is a front view of the connector shown in FIG. 1.
Figure 5:
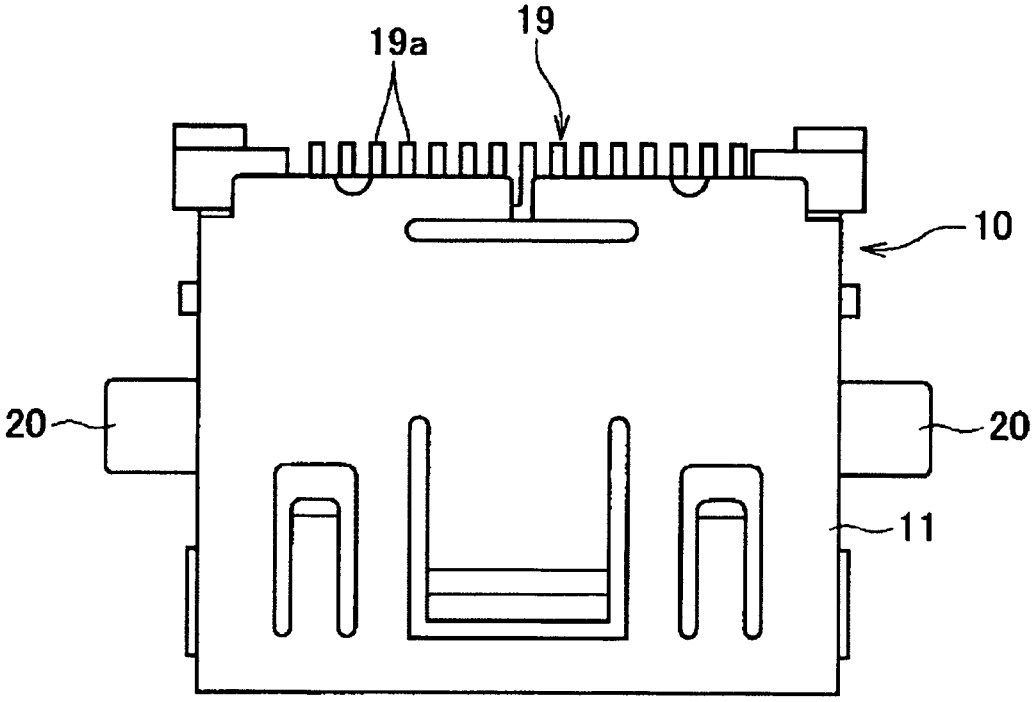
FIG. 5 is a plan view of FIG. 4.

Meanwhile, as shown in FIGS. 4 and 5, a connector 10 serving as a female connector has a housing 11, an opening 12, a slider 13 and a contact part 14. In FIG. 4, the slider 13 is hatched so as to be distinguished with respect to the other members. Likewise, the contact part 14 is shown with dots. The insertion part 2 of the plug 1 serving as a male connector is detachably inserted in the connector 10. Specifically, as shown in FIG. 4, the housing 11 is formed with the opening 12 that has a substantially inverted trapezoidal frame shape corresponding to the shape of the insertion part 2 of the plug 1 and into which the insertion part 2 of the plug 1 is detachably inserted.

In the opening 12, the slider 13 is provided so as to be capable of moving rearward from a position facing an open end of the opening 12 by a pressing means such as a spring (not shown). The slider 13 is always pressed to the position facing the open end of the opening 12 by the pressing means and is moved by inserting or pulling out the insertion part 2 of the plug 1 into or from the opening 12. In addition, the slider 13 has a function of a cover that covers the contacts 15 of the contact part 14 when the insertion part 2 of the plug 1 is pulled out from the opening 12.

The contact part 14 is made of resin, has a flat rectangular plate shape and is arranged at a substantial center in the opening 12. When the insertion part 2 of the plug 1 is inserted into the opening 12 from an insertion direction, the contact part 14 is inserted into the opening 2*a* of the insertion part 2 from a direction opposite to the insertion direction. The contact part 14 has the contacts 15 that are respectively juxtaposed on an upper surface part 16, which is a first surface, and on a lower surface part 17, which is a second surface. When the insertion part 2 of the plug 1 is inserted into the opening 12, the slider 13 is moved rearward from the position facing the open end of the opening 12 against the pressing force of the pressing means, so that the contacts 15 are exposed and thus contact the contacts 3 of the plug 1 in the opening 12, respectively.

In the opening 12 other than the portion where the contact part 14 is mounted, void parts 18*a*, 18*b*, into which a memory card, which will be described-later as an example of a plate-shaped insertion member other than the plug 1, can be inserted, are formed above and below the contact part 14. In other words, the void parts 18*a*, 18*b* have an opening width and height large enough to receive the memory card, respectively.

In addition, as shown in FIG. 5, a backside of the housing 11 is provided with a terminal part 19 for connection. The terminal part 19 for connection has a plurality of connection pins 19*a* that is juxtaposed at upper and lower portions thereof and is electrically connected to predetermined portions of a substrate which is not shown. Further, two leg parts 20 for attaching the housing 1 to a substrate, which is not shown, are provided at the lower side of the housing 11 so as protrude outwards.

According to the connector 10 configured as described above, when the insertion part 2 of the plug 1 is inserted into the opening 12 from the insertion direction, the contact part 14 is inserted into the opening 2*a* of the insertion part 2 from the direction opposite to the insertion direction. At the same time, a leading end of the insertion part 2 contacts the front side of the slider 13 and the slider 13 is moved rearward from the position facing the open end of the opening 12 against the pressing force of the pressing means, so that the contacts 15 are respectively exposed and thus contact the contacts 3 of the plug 1 in the opening 12. Thereby, the plug 1 and the connector 10 are electrically and mechanically connected. Further, when separating the plug 1 from the connector 10, a user only needs to pull out the insertion part 2 of the plug 1 from the opening 12 of the connector 10.

Hereinafter, an arrangement of the contacts 15 of the connector according to this illustrative embodiment and an arrangement of the respective contacts of the memory card that is an insertion member will be described with reference to FIGS. 6 to 9. In the arrangement view of FIG. 6, based on a horizontal central line CL, the fifteen contacts 15 of the upper half part are juxtaposed on the upper surface part 16 of the contact part 14 and the fifteen contacts 15 of the lower half part are juxtaposed on the lower surface part 17 of the contact part 14.

In the descriptions hereinafter, the fifteen contacts juxtaposed on the upper surface part 16 are indicated with reference numerals C1 to C15 and the fifteen contacts juxtaposed on the lower surface part 17 are indicated with reference numerals C16 to C30.

Figure 6:
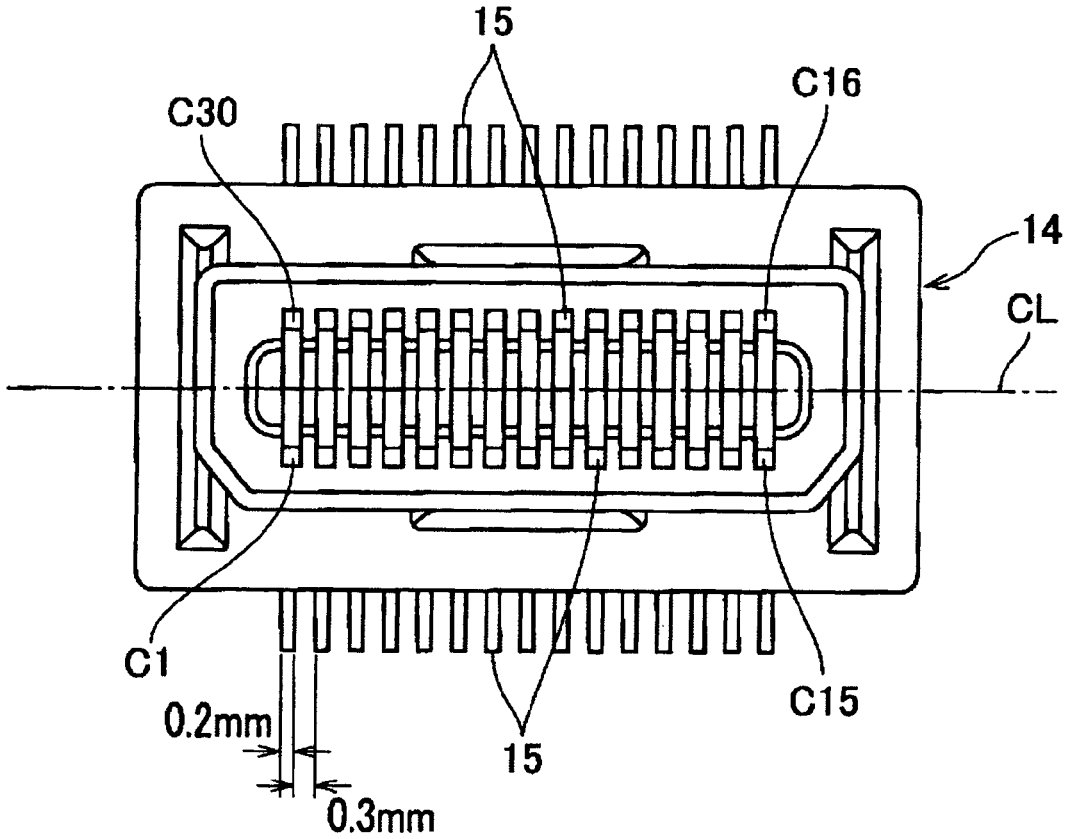
FIG. 6 shows an arrangement of respective contacts of a connector according to an illustrative embodiment of the invention.

As shown in FIG. 6, in this illustrative embodiment, the fifteen contacts C1 to C15 juxtaposed on the upper surface part 16 and the fifteen contacts C16 to C30 juxtaposed on the lower surface part 17 have a width of 0.2 mm and an arrangement interval of 0.3 mm, respectively. Thereby, the contacts C1 to C15 and the contacts C16 to C30 are arranged within a width of 7.2 mm, respectively.

Figure 7:
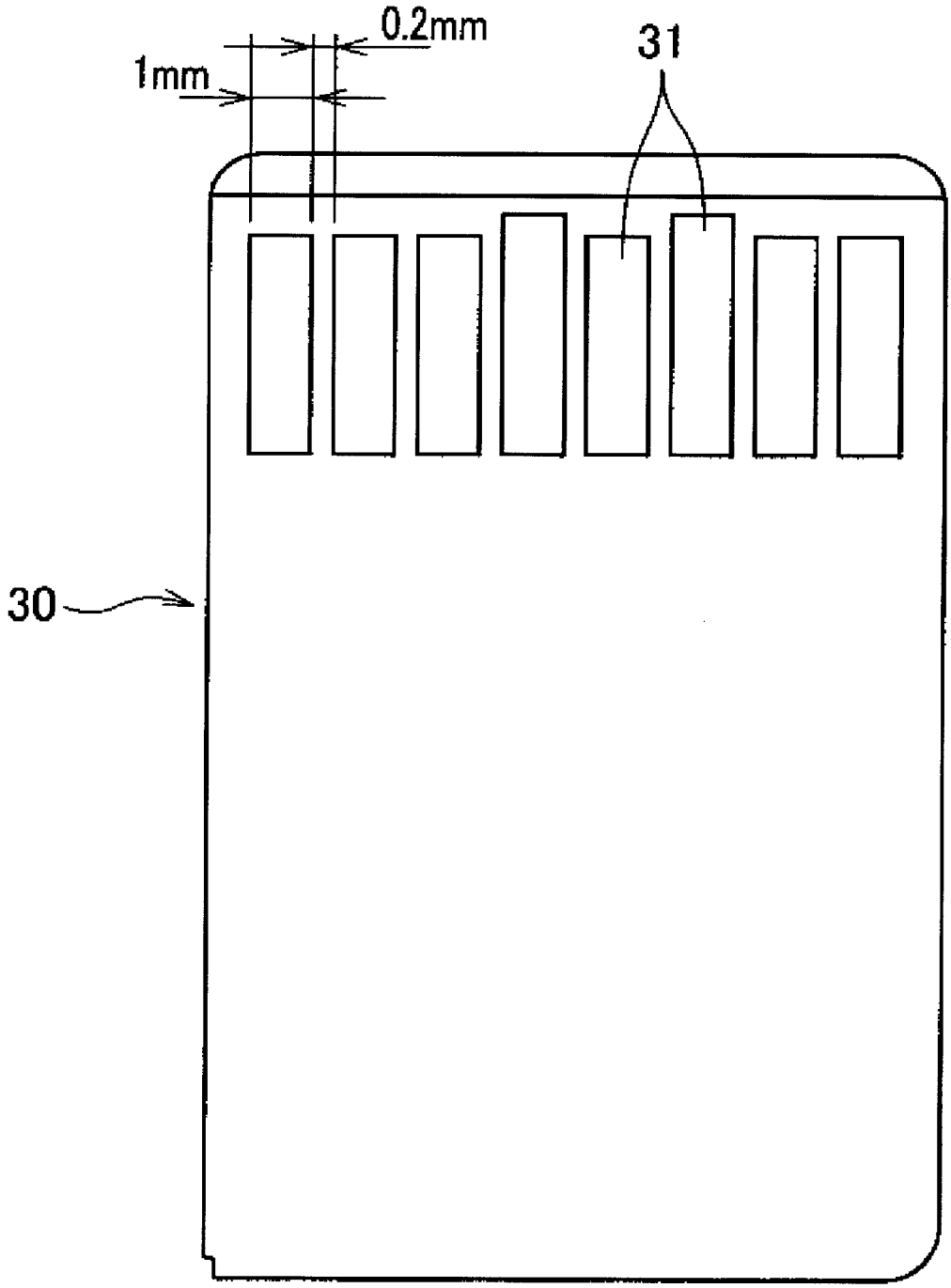
FIG. 7 shows an arrangement of respective contacts of a memory card.

Meanwhile, as shown in FIG. 7, a memory card 30 is an insertion member having a plate shape other than the plug 1 and has eight conduction parts 31 that are arranged in a width direction on an insertion side. The respective conduction parts 31 have a width of 1.0 mm and an arrangement interval of 0.2 mm, respectively. In addition, the memory card 30 has an overall thickness of 1.0 mm and a width of approximately 10.0 mm and can be inserted into one of the void parts 18*a*, 18*b* of the opening 12 of the connector 10. When the memory card is inserted, the respective conduction parts 31 contacts the contacts 15.

Types of the respective contacts are described with reference to FIGS. 8 and 9.

Figure 8:
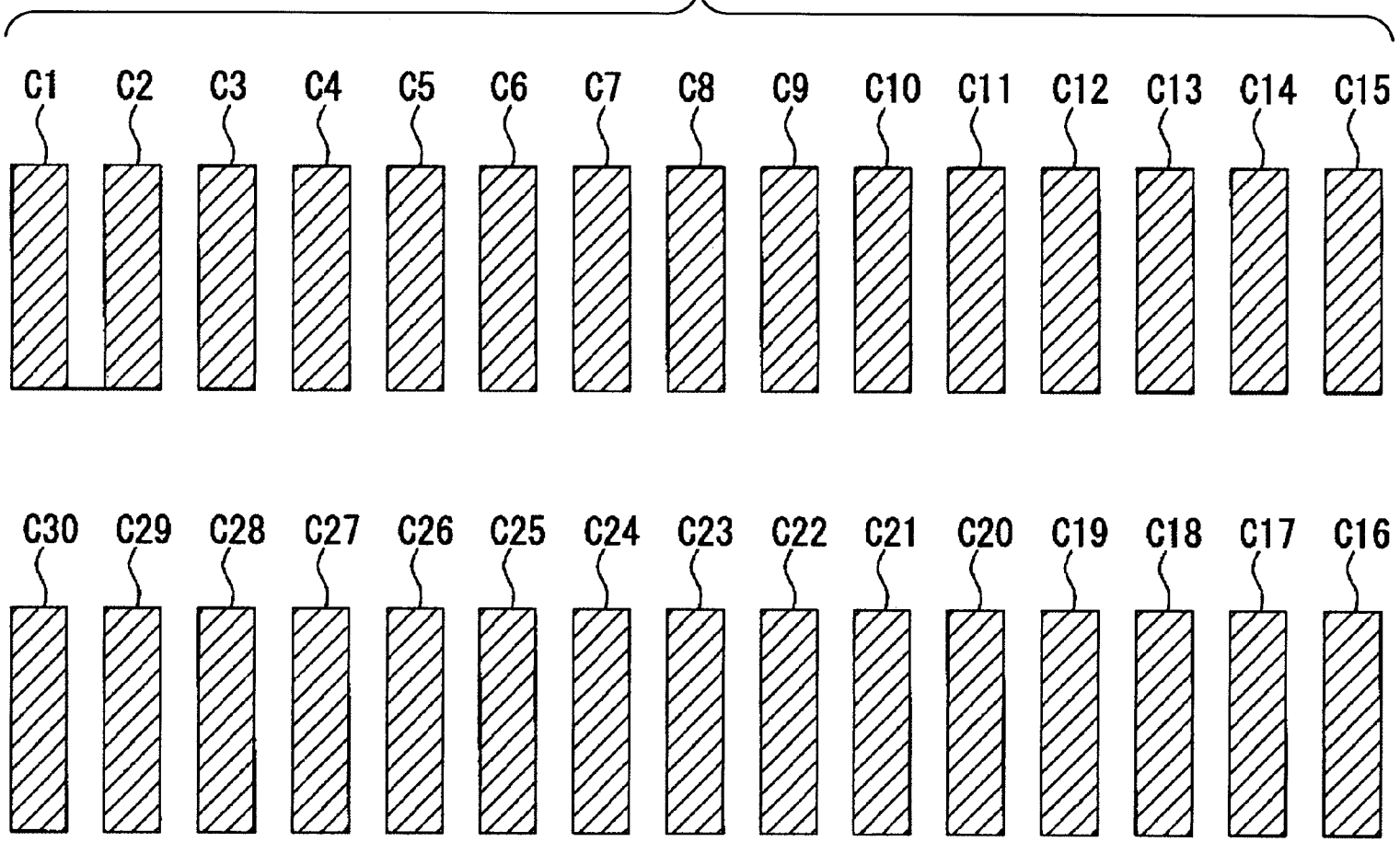
FIG. 8 schematically shows an arrangement of the respective contacts of FIG. 6.

As shown in FIGS. 8 and 9, the contacts C1 to C5 are first power contacts, the contacts C6, C7 are data signal contacts, the contacts C8 to C10 are second power contacts, the contacts C11, C12 are data signal contacts and the contacts C13 to C15 are third power contacts.

Meanwhile, the first power contacts C1 to C5, the second power contacts C8 to C10 and the third power contacts C13 to C15 are classified because they have different potentials and are connected to different portions. In other words, the first power contacts C1 to C5 have the same potential, the second power contacts C8 to C10 have the same potential and the third power contacts C13 to C15 have the same potential.

In addition, the contacts C16, C17, C19, C21 to C25, C27, C29 and C30 are ground contacts and the contacts C18, C20, C26 and C28 are clock signal contacts. The clock signal contacts C18, C20, C26 and C28 are arranged on the lower surface part 17 and have an input frequency that is higher than that of the data signal contacts C6, C7, C11 and C12 arranged on the upper surface part 16 by 2 MHz or more.

Hereinafter, operations and effects of this illustrative embodiment will be described.

In this illustrative embodiment, the first power contacts C1 to C5, the second power contacts C8 to C10 and the third power contacts C13 to C15 are arranged on the upper surface part 16 and the ground contacts C16, C17, C19, C21 to C25, C27, C29 and C30 are arranged on the lower surface part 17.

In other words, the first power contacts C1 to C5, the second power contacts C8 to C10 and the third power contacts C13 to C15 are arranged so as to be spaced from the ground contacts C16, C17, C19, C21 to C25, C27, C29 and C30, such that even when the memory card 30, which is an insertion member other than the plug 1, is inserted into one of the void parts 18*a*, 18*b* formed above and below the contact part 14, the conduction parts 31 of the memory card 30 do not contact both the power contacts C1 to C5, C8 to C10, C13 to C15 and the ground contacts C16, C17, C19, C21 to C25, C27, C29 and C30 at the same time.

According to this illustrative embodiment, the first power contacts C1 to C5, the second power contacts C8 to C10 and the third power contacts C13 to C15 are arranged on the upper surface part 16 and the ground contacts C16, C17, C19, C21 to C25, C27, C29 and C30 are arranged on the lower surface part 17. Accordingly, even when the memory card 30, which is an insertion member other than the plug 1, is erroneously mounted, the power contacts C1 to C5, C8 to C10, C13 to C15 and the ground contacts C16, C17, C19, C21 to C25, C27, C29 and C30 are prevented from being shorted out, so that the reliability can be improved.

In this illustrative embodiment, the first power contacts C1 to C5, the second power contacts C8 to C10 and the third power contacts C13 to C15 are arranged on the upper surface part 16 and the ground contacts C16, C17, C19, C21 to C25, C27, C29 and C30 are arranged on the lower surface part 17. That is, the first power contacts C1 to C5, the second power contacts C8 to C10 and the third power contacts C13 to C15 and the ground contacts C16, C17, C19, C21 to C25, C27, C29 and C30 are arranged on the opposing surfaces. However, the invention is not limited thereto. For example, the same effects can be obtained even when the power contacts and the ground contacts are arranged on upper and lower mount surfaces that are formed stepwise. In addition, the power contacts and the ground contacts may be arranged on respective surfaces forming an L-shaped front face. In other words, in the invention, any positional relationship between the surface on which the power contacts are arranged and the surface on which the ground contacts are arranged is possible as far as the surfaces have different positions or angles.

In this illustrative embodiment, on the upper surface part 16, the power contacts having the same potential are grouped and arranged to be adjacent to each other, such as the first power contacts C1 to C5, the second power contacts C8 to C10 and the third power contacts C13 to C15, which have the same potential, respectively. Thereby, even when the memory card 30 is erroneously mounted in any one of the void parts 18*a*, 18*b*, the first power contacts C1 to C5, the second power contacts C8 to C10 and the third power contacts C13 to C15 whose potential are different are prevented from being shorted out.

In this illustrative embodiment, the first power contacts C1 to C5, the second power contacts C8 to C10 and the third power contacts C13 to C15 are arranged on the upper surface part 16. Further, the data signal contacts C6, C7 are arranged between the first power contacts C1 to C5 and the second power contacts C8 to C10 having different potentials, and the data signal contacts C11, C12 are arranged between the second power contacts C8 to C10 and the third power contacts C13 to C15 having different potentials.

Thereby, the first power contacts C1 to C5 and the second power contacts C8 to C10 having different potentials are spaced from each other so as not to contact each other, and the second power contacts C8 to C10 and the third power contacts C13 to C15 having different potentials are spaced from each other so as not to contact each other. Accordingly, even when the memory card 30 is erroneously mounted in any one of the void parts 18*a*, 18*b*, the first power contacts C1 to C5 and the second power contacts C8 to C10 having different potentials and the second power contacts C8 to C10 and the third power contacts C13 to C15 having different potentials are prevented from being shorted-out therebetween, respectively.

In this illustrative embodiment, the clock signal contacts C18, C20, C26 and C28, which are the signal contacts having the higher input clock frequency than the data signal contacts C6, C7, C11, C12 serving as signal contacts arranged on the upper surface part 16, are arranged on the lower surface part 17. Thereby, since the clock signal contacts C18, C20, C26 and C28 having the higher input clock frequency are arranged on the lower surface part 17 on which the ground contacts C16, C17, C18, C21 to C25, C27, C29 and C30 are arranged, it is possible to lower the influence of the noise due to the high frequency.

In the above-described illustrative embodiment the invention is applied to a connector that is used, for example, for interface connection in various small-sized electronic devices. However, the invention is not limited thereto. For example, the invention can be applied to any connector as far as the connector has an opening into which an insertion member other than a plug can be inserted and a plurality of contacts which is configured to contact a plurality of contacts of the plug in the opening.

According to the invention, the power contact is arranged on the first surface and the ground contact is arranged on the second surface different from the first surface. Accordingly, even when an insertion member other than a plug, for example a memory card is erroneously mounted, the power contact and the ground contact are not shorted, so that the reliability is considerably improved.

What is claimed is:

1. A connector comprising:

a housing having an opening into which a plug is detachably inserted and an insertion member other than the plug can be inserted; and a plurality of contacts that includes a power contact and a ground contact and is configured to contact a plurality of contacts of the plug in the opening, wherein the power contact is arranged on a first surface and the ground contact is arranged on a second surface, a position of the first surface being different from a position of the second surface, and wherein a plurality of power contacts having a same potential are arranged adjacent to each other on the first surface.

2. The connector according to claim 1, wherein a plurality of power contacts having different potentials are arranged on the first surface and a signal contact is arranged between the power contacts having the different potentials.

3. The connector according to claim 1, wherein signal contacts are respectively arranged on the first surface on which the power contact is arranged and on the second surface on which the ground contact is arranged, and wherein the signal contact arranged on the second surface has a higher input clock frequency than that of the signal contact arranged on the first surface.

4. A connector comprising:

a housing;

an opening that is provided to the housing and into which a plug is configured to be detachably inserted; and a plurality of contacts that includes a power contact and a ground contact and is configured to contact a plurality of contacts of the plug in the opening, wherein the power contact is arranged on a first surface and the ground contact is arranged on a second surface, a position of the first surface being different from a position of the second surface, and wherein a plurality of power contacts having a same potential are arranged adjacent to each other on the first surface.

* * * * *